US007694899B2

(12) United States Patent
Gerakis et al.

(10) Patent No.: US 7,694,899 B2
(45) Date of Patent: Apr. 13, 2010

(54) FUEL INJECTION DEVICE FOR AN AIRCRAFT GAS TURBINE

(75) Inventors: Jeffrey-George Gerakis, Berlin (DE); Leif Rackwitz, Rangsdorf (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 0 days.

(21) Appl. No.: 11/826,231

(22) Filed: Jul. 13, 2007

(65) Prior Publication Data

US 2008/0011883 A1 Jan. 17, 2008

(30) Foreign Application Priority Data

Jul. 13, 2006 (DE) ..... 10 2006 032 429

(51) Int. Cl.

| | |
|---|---|
| ***F02M 61/00*** | (2006.01) |
| ***F02M 63/00*** | (2006.01) |
| ***F23D 11/10*** | (2006.01) |
| ***F23D 11/12*** | (2006.01) |
| ***F23D 11/14*** | (2006.01) |
| ***B05B 7/06*** | (2006.01) |
| ***F02C 1/00*** | (2006.01) |

(52) U.S. Cl. ..... 239/601; 239/423; 239/424; 239/533.2

(58) Field of Classification Search ..... 239/418, 239/423, 424, 451, 533.2, 589, 601; 60/740, 60/741

See application file for complete search history.

(56) References Cited

U.S. PATENT DOCUMENTS

2004/0195402 A1* 10/2004 Joshi ..... 239/601
2005/0097889 A1* 5/2005 Pilatis et al. ..... 60/743

* cited by examiner

*Primary Examiner*—Darren W Gorman
(74) *Attorney, Agent, or Firm*—Timothy J. Klima; Shuttleworth & Ingersoll, PLC

(57) ABSTRACT

A fuel injection device for fuel injection systems, e.g. for aircraft gas turbines, includes at least one fuel injection opening, through which a continuous flow of fuel 1 is issued, with the fuel injection opening having a non-circular cross-section.

8 Claims, 5 Drawing Sheets

FUEL INJECTION DEVICE FOR AN AIRCRAFT GAS TURBINE

Figure 1:
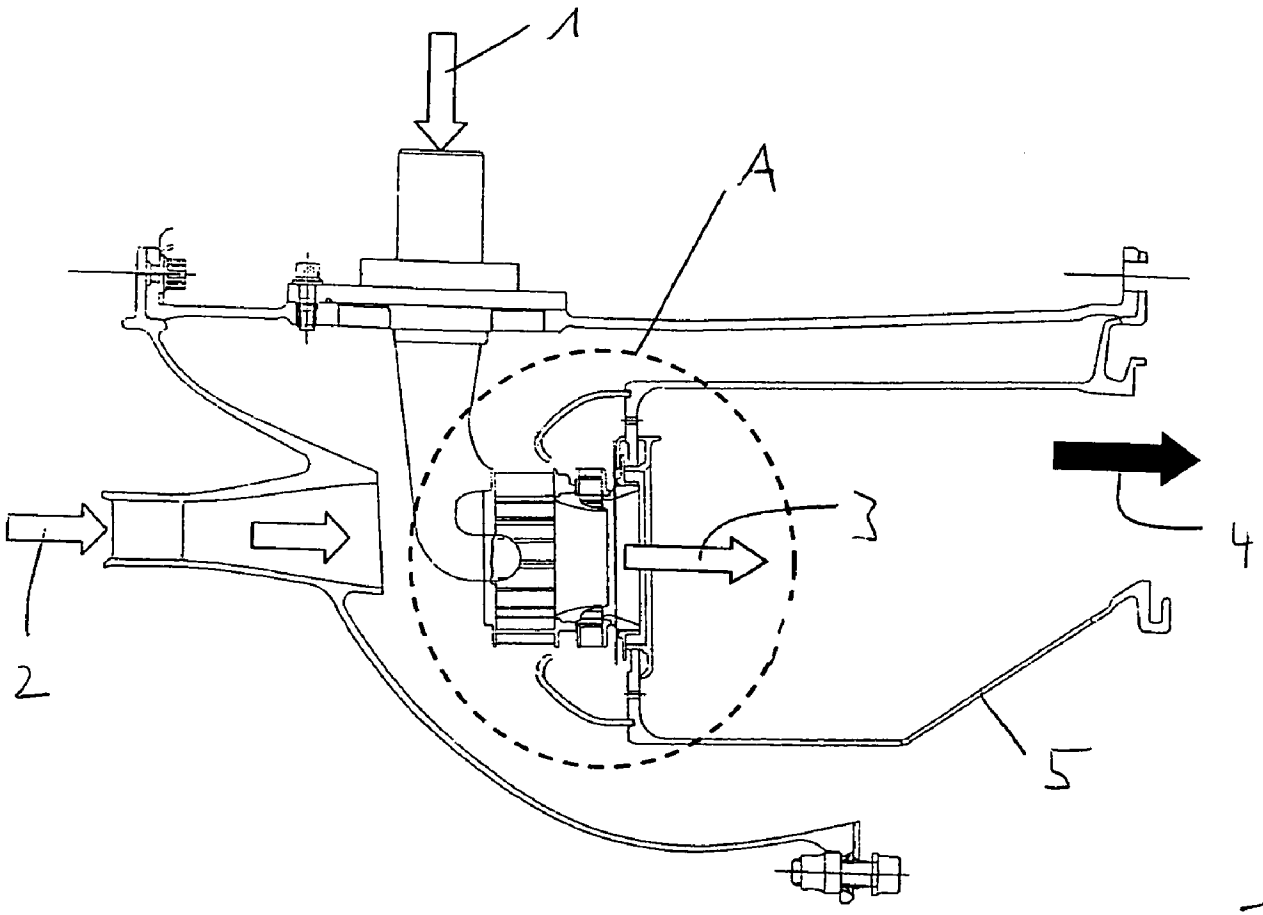

This application claims priority to German Patent Application DE 10 2006 032 429.3 _filed Jul. 13, 2006, the entirety of which is incorporated by reference herein.

This invention relates to a fuel injection device for an aircraft gas turbine. Furthermore the invention relates to stationary gas turbines and to all types of injection systems in general.

More particularly, this invention relates to a fuel injection device for an aircraft gas turbine with at least one fuel injection opening through which a continuous flow of fuel is issued.

In combustion processes, injection of the fuel into the combustion chamber space is normally accomplished by means of fuel nozzles or individual injection elements whose openings have circular cross-section. Respective applications are known in the areas of gas turbines, spark-ignition and compression-ignition piston engines, rotary combustion engines, rocket engines etc. For aircraft gas turbines, airflow atomizers are often used, where a fuel film with low fuel-air-pulse ratio produced via an annular cross-section is atomized with maximum homogeneity by the high airflow velocities. For oil systems of combustion engines, annular exit openings are also used to supply the lubricants to the respective lubrication chambers.

With regard to a significant reduction of pollutant emission, in particular nitrogen oxides NOx, it is important to obtain a droplet spectrum with minimum droplet diameter. Smaller fuel droplets enable the surface to be maximized for a given fuel volume, thus accelerating transformation from the liquid phase to the gas phase of the fuel. This provides for an improved fuel-air mixture, enabling a more homogenous temperature distribution with lower temperature peaks in the combustion chamber space to be obtained.

Improved mixture preparation with, on average, small droplet diameters, is achievable by both enhancement of burner aerodynamics and enhancement of the fuel input. The present invention relates to optimization of the fuel input.

Specification DE-A-103 48 604, for example, teaches an embodiment that comes closest to the state of the art. The present invention, in a broad aspect, provides a fuel injection device or an optimized exit geometry of a fuel nozzle, respectively, which ensures optimized fuel vaporization, while being characterized by simple design and simple and cost-effective producibility.

It is a particular object of the present invention to provide an improved fuel injection device having a combination of the features described herein. Further advantageous embodiments will be apparent from the present description.

The present invention accordingly provides for injection of the liquid fuel into the combustion chamber space via a non-circular exit cross-section.

For a continuously flowing fluid as applied in gas turbine combustion chambers, with individual or multiple fuel jets sprayed into a cross flow, for example, a non-circular cross-section according to the present invention will result in an intensification of the surface disintegration of the liquid jet due to enlargement of the surface per volume element of the liquid. The angled surface structure of the non-circular fuel jet furthermore leads to a reduction of the "core jet" of the liquid, as a result of which jet disintegration and further breakup into ligaments and droplets will start earlier than with a circular jet of the same volume flow. Owing to the effects described, a fuel distribution with smaller droplet diameters is expected from a non-circular exit cross-section.

According to the present invention, it is therefore proposed to provide a non-circular exit cross-section for spraying the liquid fuel into the combustion chamber. For a gas turbine burner, this applies to an exit gap as well as to the discrete injection of fuel with individual or multiple jets.

In the case of annular fuel input onto a film applicator, as for example on a so-called airflow atomizer, the velocity pulse of the fuel mass flow is very low relative to the air mass flow. Atomization of the fuel film generated is, therefore, effected by the turbulent shear forces of the gas flow. A non-circular design of the film applicator can further intensify breakup and disintegration of the fuel film since the film, due to the angled structure, will have an enlarged surface. Using an appropriate geometry of the film applicator, this can result in intensified breakup of the liquid film and in smaller droplets in the subsequent disintegration processes.

The proposed contouring of fuel injection advantageously results in improved fuel preparation with, on average, reduced droplet diameters. Significant reduction of NOx emissions is achievable by way of more homogenous fuel distribution and associated reduced fuel vaporization time.

Figure 9:
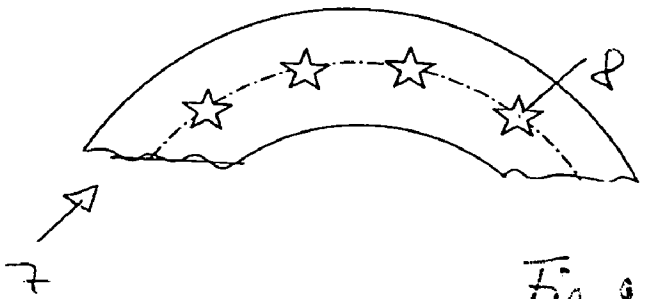
Figure 10:
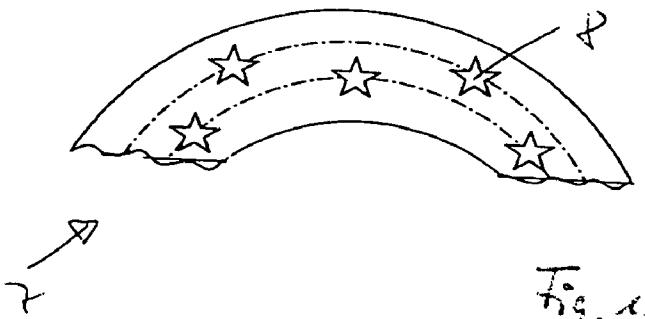
Figure 8:
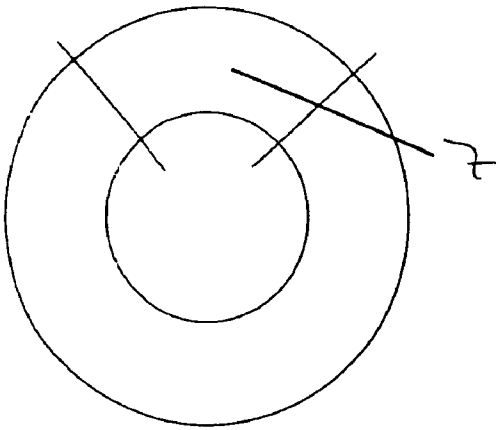

The present invention is more fully described in light of the accompanying drawings showing preferred embodiments. In the drawings, FIG. 1 is a schematic general view of a gas turbine combustion chamber in accordance with the present invention, FIGS. 2 to 6 are schematic representations of various embodiments of outlet geometries, FIG. 7 shows another embodiment of a fuel injection opening, FIG. 8 is a schematic frontal view of a fuel nozzle, and FIGS. 9 and 10 show embodiments for the arrangement of fuel injection openings in accordance with the present invention.

Figure 11:
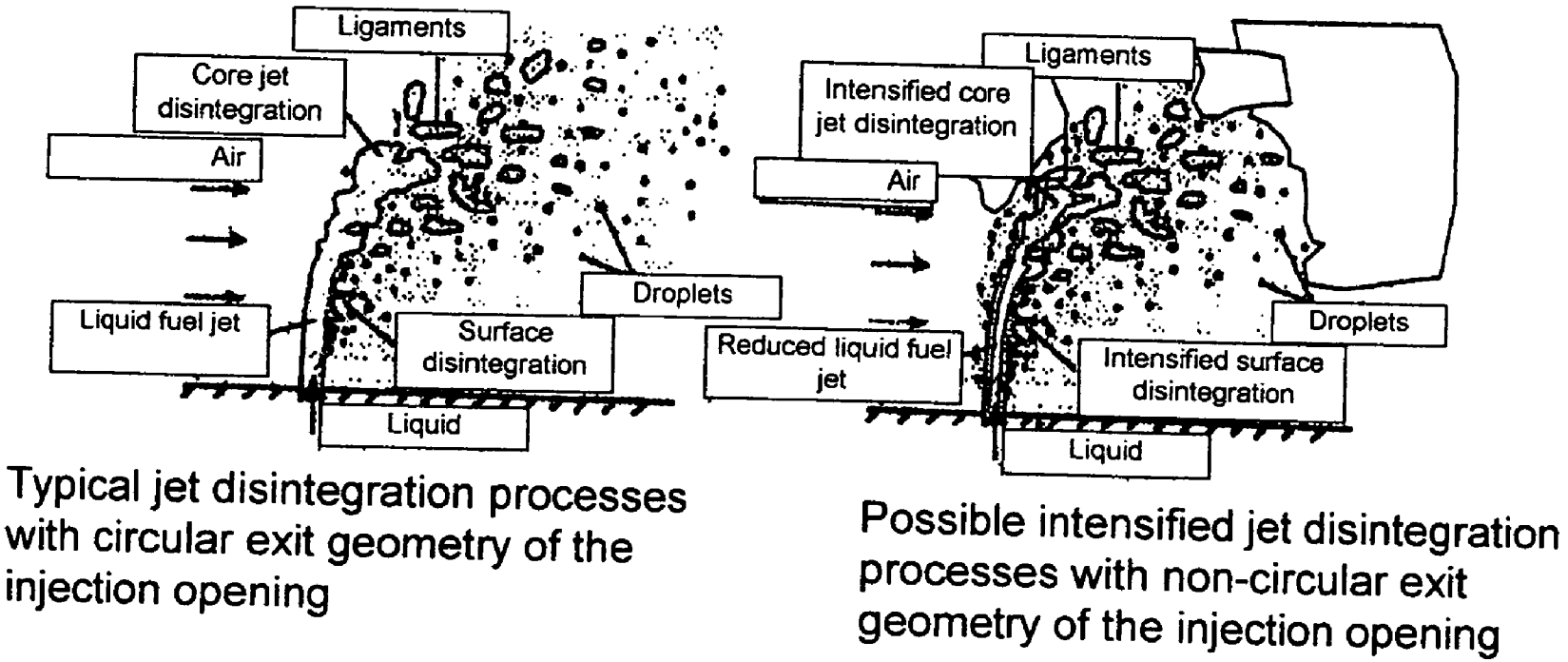

FIG. 11 is a schematic representation of the expected jet disintegration processes for a circular and a non-circular outlet geometry of a liquid fuel jet.

FIG. 1 is a schematic representation of an aircraft gas turbine combustion chamber. Arrowhead 1 indicates the inflow of fuel, while arrowhead 2 indicates the inflow of air. The fuel nozzle, whose position is generally indicated by the circle A, issues fuel-air mixture 3 which exits as exhaust gas 4 upon combustion in a combustion chamber 5.

Figures 2, 3, 4, 5, 6:
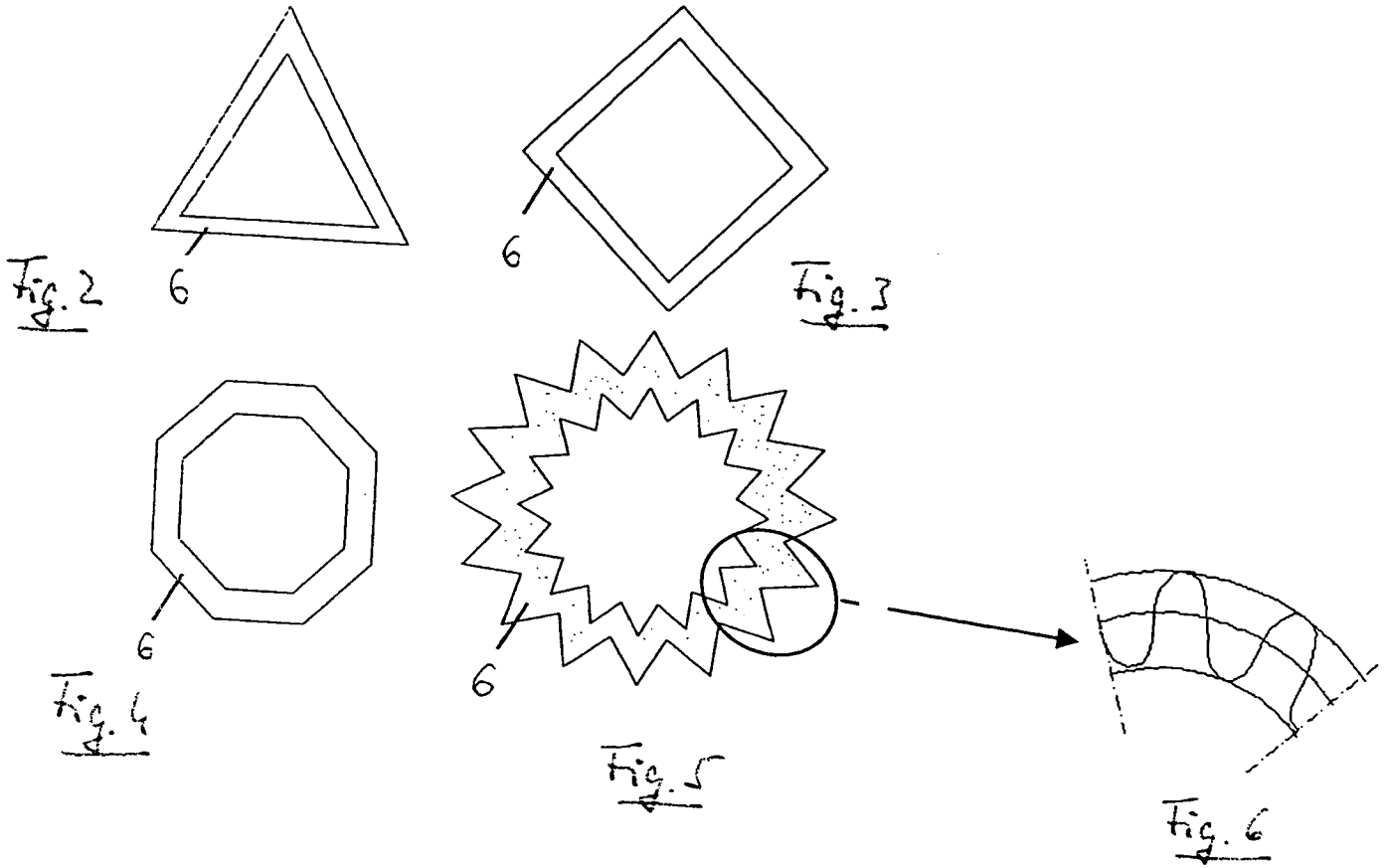
Figure 2:
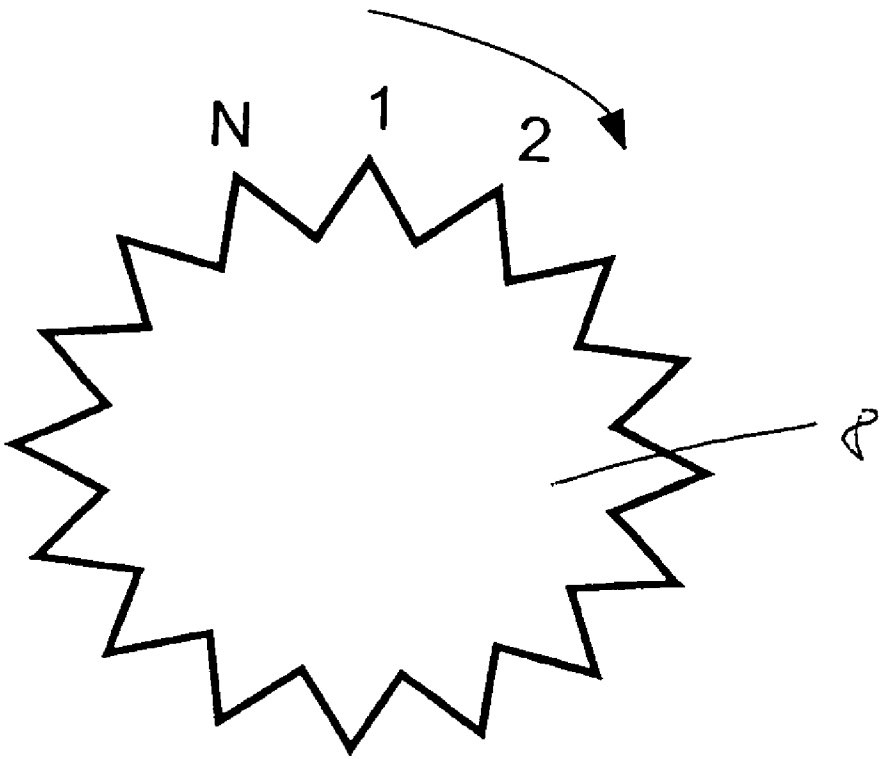

FIGS. 2 to 5 show, in schematic representation, various designs of the exit area of a film applicator for a gas turbine combustion chamber. FIGS. 2-5 show gap type exit geometries where the fuel flows between an outer boundary and an inner boundary. Here, the Figures show the direction of view upstream towards the burner. Various polygonal designs of non-circular exit geometries are shown in the schematic representations. FIG. 2 shows a three-sided, three point exit geometry, FIG. 3 a four-sided, four point exit geometry, FIG. 4 an eight-sided, eight point exit geometry and FIG. 5 shows a thirty-two sided, sixteen point exit geometry. Departing from the circular design known from the state of the art, the exit area is accordingly changed to an N point exit geometry, which can be applied to only the outer geometry of the exit area or to both the outer geometry and the inner geometry of a gap type exit area. N is here any number between N=3 and N=100, inclusive. FIG. 6 shows a further modification of the possible geometry with a wavy peripheral contour.

FIG. 7 shows a design of an N point symmetry for multi-point exit geometries for fuel injection systems, for example on aircraft gas turbine combustion chambers. Shown here is a discrete exit opening having no inner boundary, only an outer boundary.

FIG. 8 shows, in schematic frontal view (for clarification of the representations in FIGS. 9 and 10), the annular arrangement of discrete injection openings for a gas turbine burner. Fuel is here sprayed in via discrete individual holes. The individual fuel injection openings can here be arranged in a single row (FIG. 9) or in multiple rows (FIG. 10).

FIG. 11 schematically shows the expected jet disintegration processes for a circular and a non-circular exit geometry of a liquid fuel jet. It is expected that the disintegration processes, with regard to core jet and surface disintegration, are intensified with a non-circular exit geometry, i.e. that they start earlier and result in smaller droplets with improved mixture formation and, ultimately, reduced NOx formation, as compared to a circular exit geometry.

LIST OF REFERENCE NUMERALS

1 Fuel
2 Air
3 Fuel-air mixture
4 Exhaust gas
5 Combustion chamber
6 Exit gaps
7 Detail area
8 Individual opening

What is claimed is:

1. A fuel injection device for a fuel injection system of a gas turbine, the fuel injection device comprising:

an annular film application surface through which a mass of combustion air flows, the annular film application surface having a non-circular cross-section;

at least one fuel injection opening, through which a continuous flow of fuel is issued onto the annular film application surface for atomization into the combustion air flow;

wherein the at least one fuel injection opening is a single exit gap opening positioned around an annulus of the film application surface and both the fuel injection opening and the annular film application surface have a polygonal cross-section.

2. A fuel injection device in accordance with claim 1, wherein the polygonal cross-section includes between 3 and 100 N points, inclusive.

3. A fuel injection device for a fuel injection system of a gas turbine, the fuel injection device comprising:

an annular film application surface through which a mass of combustion air flows, the annular film application surface having a non-circular cross-section;

at least one fuel injection opening, through which a continuous flow of fuel is issued onto the annular film application surface for atomization into the combustion air flow;

wherein the annular film application surface has a polygonal cross-section and the at least one fuel injection opening includes a plurality of discrete openings positioned around an annulus of the film application surface to form a polygonal cross-section similar to that of the annular film application surface.

4. A fuel injection device for a fuel injection system of a gas turbine, the fuel injection device comprising:

an annular film application surface through which a mass of combustion air flows, the annular film application surface having a non-circular cross-section;

at least one fuel injection opening, through which a continuous flow of fuel is issued onto the annular film application surface for atomization into the combustion air flow;

wherein the at least one fuel injection opening includes a plurality of discrete openings positioned around an annulus of the film application surface to form a non-circular cross-section similar to that of the annular film application surface.

5. A fuel injection device for a fuel injection system of a gas turbine, the fuel injection device comprising:

an annular film application surface through which a mass of combustion air flows, the annular film application surface having a non-circular cross-section;

at least one fuel injection opening, through which a continuous flow of fuel is issued onto the annular film application surface for atomization into the combustion air flow;

wherein the at least one fuel injection opening is a single exit gap opening positioned around an annulus of the film application surface and both the fuel injection opening and the annular film application surface have a similar non-circular cross-section.

6. A fuel injection device for a fuel injection system of a gas turbine, the fuel injection device comprising:

an annular film application surface through which a mass of combustion air flows;

at least one fuel injection opening, through which a continuous flow of fuel is issued onto the annular film application surface for atomization into the combustion air flow, the at least one fuel injection opening configured in an annular manner of a non-circular cross-section around an annulus of the film application surface such that the combustion air also flows through an annulus of the configuration of the at least one fuel injection opening.

7. A fuel injection device in accordance with claim 6, wherein the at least one fuel injection opening is a single exit gap opening positioned around an annulus of the film application surface.

8. A fuel injection device in accordance with claim 6, wherein the at least one fuel injection opening includes a plurality of discrete openings positioned around an annulus in the annular configuration of non-circular cross-section.

* * * * *